United States Patent [19]

Pezzot

[11] 4,295,804

[45] Oct. 20, 1981

[54] INTERMEDIATELY COOLED AIR VACUUM PUMP WITH BALANCING OF THE PRESSURES

[76] Inventor: Adriano Pezzot, Via Udine, 8, 33094 Cordenons (Pordenone), Italy

[21] Appl. No.: 54,842

[22] Filed: Jul. 5, 1979

[30] Foreign Application Priority Data

Nov. 7, 1978 [IT] Italy ..... 83499 A/78

[51] Int. Cl.[3] ..... F04C 18/00; F04C 29/04

[52] U.S. Cl. ..... 418/15; 418/83

[58] Field of Search ..... 418/15, 180, 259, 83

[56] References Cited

U.S. PATENT DOCUMENTS

| | | | |
|---|---|---|---|
| 1,558,639 | 10/1925 | Schmied | 418/180 |
| 2,639,855 | 5/1953 | Daniels | 418/15 |
| 3,199,771 | 8/1965 | Becker | 418/15 |

FOREIGN PATENT DOCUMENTS

| | | | |
|---|---|---|---|
| 1052439 | 9/1953 | France | 418/15 |
| 585072 | 11/1958 | Italy | 418/15 |
| 818691 | 8/1959 | United Kingdom | 418/15 |

*Primary Examiner*—John J. Vrablik

*Attorney, Agent, or Firm*—Richard C. Woodbridge

[57] ABSTRACT

An air vacuum pump is provided with a plurality of venting passageways in order to balance internal pressures. The present invention is found in the context of a vacuum pump or decompressor of the type having an eccentric rotor with radial lamellae mounted thereon. As the rotor turns the lamellae form intermediate chambers which produce suction and compression. According to a preferred embodiment of the invention one passageway is located to vent the chamber having the biggest volume just downstream of the suction portion of the pump. More specifically the passageway is located such that the arc along the inner surface of the chamber of the stator between the passageway and the discharge outlet is equal to or greater than the arc between the two adjoining lamellae of the rotor which occupy that portion of the chamber.

1 Claim, 6 Drawing Figures

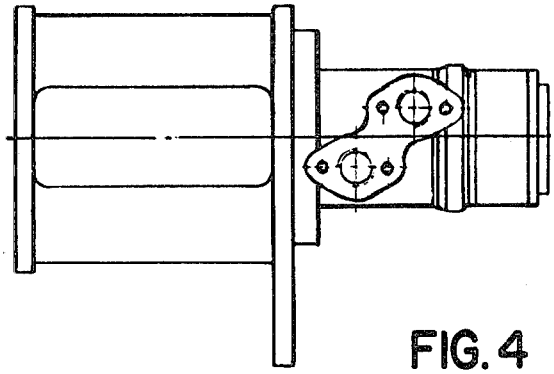
FIG. 4
FIG. 5
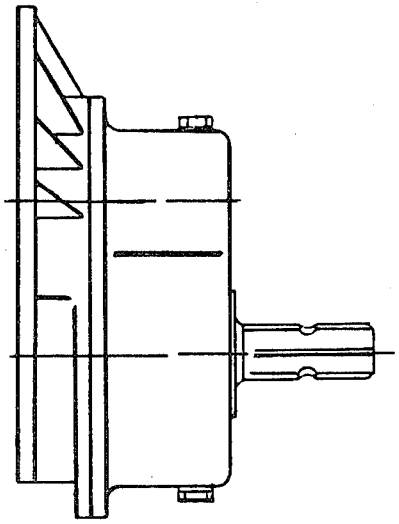
FIG. 6
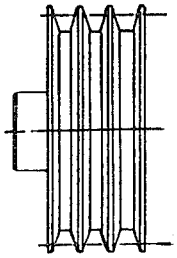

INTERMEDIATELY COOLED AIR VACUUM PUMP WITH BALANCING OF THE PRESSURES

BACKGROUND OF THE INVENTION

1. Field of the Invention

This invention relates to an improved air vacuum pump having a vent passage therein in order to balance internal pressures generated during the pumping process.

2. Description of the Prior Art

The use of vacuum pumps to create a suction and draw air from a container are known to those of ordinary skill in the art. However, vacuum pumps have a variety of other purposes and applications. The following is a description of different structures and functions for vacuum pumps in common use.

A primary category of vacuum pumps actually used and known to those of ordinary skill in the art are those which operate by means of an eccentric rotor having lamellae or vanes mounted thereon. Typically, the pump housing includes a stator having an internal chamber with a generally cylindrical shape. The eccentrically mounted rotor is furnished with a plurality of lamellae which are pulled outwardly from the rotor by centrifugal force and which form a tight revolving seal against the inside of the cylindrical chamber. Adjacent lamellae form chambers having variable volume depending upon their position with respect to the stator chamber. More specifically, the variable volume chambers are formed between the inner surface of the cylindrical chamber, the outer surface of the rotor and the facing surfaces of adjacent lamellae. In order to obtain suction a port is provided immediately downstream of the area having the minimum radius between the rotor and the cylindrical chamber of the stator body. An exit port is typically placed just upstream of that location. Such vacuum pumps are often referred to as decompressors and are typically employed to pump gases such as air.

Because of their structure, the pumps just described tend to develop large amounts of heat. Much of the heat is produced by the friction of the rotor lamellae against the inner surface of the cylindrical stator chamber. Heat is also generated by the changing volume of the gas as it is compressed in the pump. Therefore, many prior art pumps of this nature are water cooled and have to be very efficiently designed if used for heavily loaded operations or if employed under conditions of stress.

It is also known in the prior art to furnish the stator of an air cooled pump with fins in order to more efficiently dissipate the heat generated by the pump. Unfortunately, air cooling is not an efficient manner of removing heat from heavy pumps which operate for long periods of time. Examples of typical prior art pumps may be found in the Catalog of the inventor. The catalog is entitled "Air Cooled Vacuum Pumps Jurop" and the specific pumps bear model numbers P5M, P35, P3, P5N, P4N, P6N, etc. Accordingly, there exists a great need for efficient and powerful pumps which can operate for long periods of time under heavy stress and which do not require water cooling, or other extraordinary remedies in order to dissipate heat.

Water cooled pumps present special disadvantages when compared to air cooled systems. Specifically they often require a double walling in order to form a jacket for the water cooling liquid. Moreover, special piping may be required to provide cooling liquid to the water jacket and some sort of pumping mechanism is often employed to force the cooling liquid through the water jacket.

It seems evident that if an air cooled vacuum pump could be produced having the desirable cooling characteristics of a water cooled vacuum pump, then the advantages would be most important. For example, because an air cooled pump would not require the complicated piping structure of a water cooled pump, such a pump might be manufactured relatively simply.

Therefore, the purpose and object of the present invention is to provide an efficient air cooled vacuum pump which does not require cooling liquid. Such a pump is relatively simple in structure and accordingly, production costs are minimized. Moreover, the efficiency of the vacuum pump which is the subject of the invention is such that it can function for long periods of time under conditions of high stress without the danger of exhaustion or jamming which frequently occur when water cooled vacuum pumps are employed.

SUMMARY OF THE INVENTION

Briefly described the present invention comprises an air cooled vacuum pump having a cylindrical stator chamber and an eccentrically mounted rotor having movable lamellae mounted therein. Adjacent lamellae form rotating chambers of variable volume as they spin within the cylindrical housing of the stator. According to the present invention one or more air passageways are provided to communicate with one of the intermediate chambers formed by the rotor lamellaes. The air passageway is preferably located after the suction port in the chamber of major volume.

The air passageway is located such as to avoid the compression of the liquid or gas after the expansion phase has begun following the suction phase. Cooling is provided essentially by an inner circulation of fresh air into the rotating lamellae chambers so as to lower the working temperature inside the pump. The air passageways are efficiently placed so as to prevent the air inside from compressing and subsequently overheating. Pumps of the type just described generally undergo expansion during a first 180° arc of rotation. Therefore, during the expansion cycle the pumps tend to cool. According to the present invention an air passageway or air passageways are provided to communicate the chamber area associated with the second 180° of arc in order to prevent the gas from compressing and therefore heating the stator body.

These and other features of the present invention will be more fully understood with reference to the following brief description of the drawings and the detailed description of the preferred embodiment which follows.

BRIEF DESCRIPTION OF THE DRAWINGS

FIG. 4 is a side elevational view of a conventional hydraulic transmission of the sort employed with the preferred embodiment of the invention.

FIG. 5 is a side elevational view of a conventional speed multiplier of the sort employed with the preferred embodiment of the present invention.

FIG. 6 is a side elevational view of a conventional pulley of the sort associated with the conventional transmission of FIG. 4 which drives the pump of the preferred embodiment described in FIGS. 1–3.

DETAILED DESCRIPTION OF THE PREFERRED EMBODIMENT

During the course of this description like numbers and letters will be used to indicate like elements according to the different views of the invention.

Figure 1:
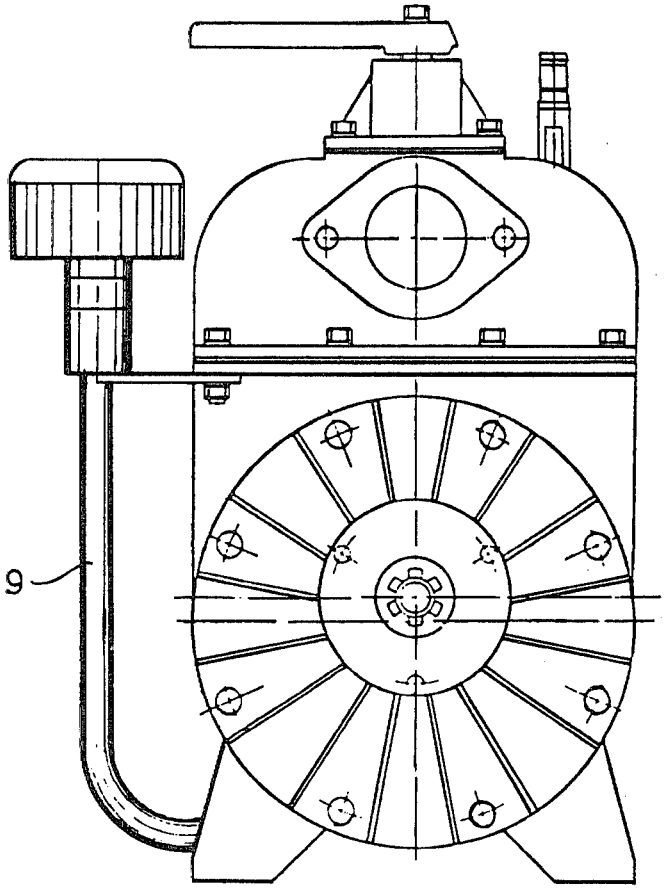
FIG. 1 is a side elevational view of the vacuum pump according to the preferred embodiment of the invention.
Figure 2:
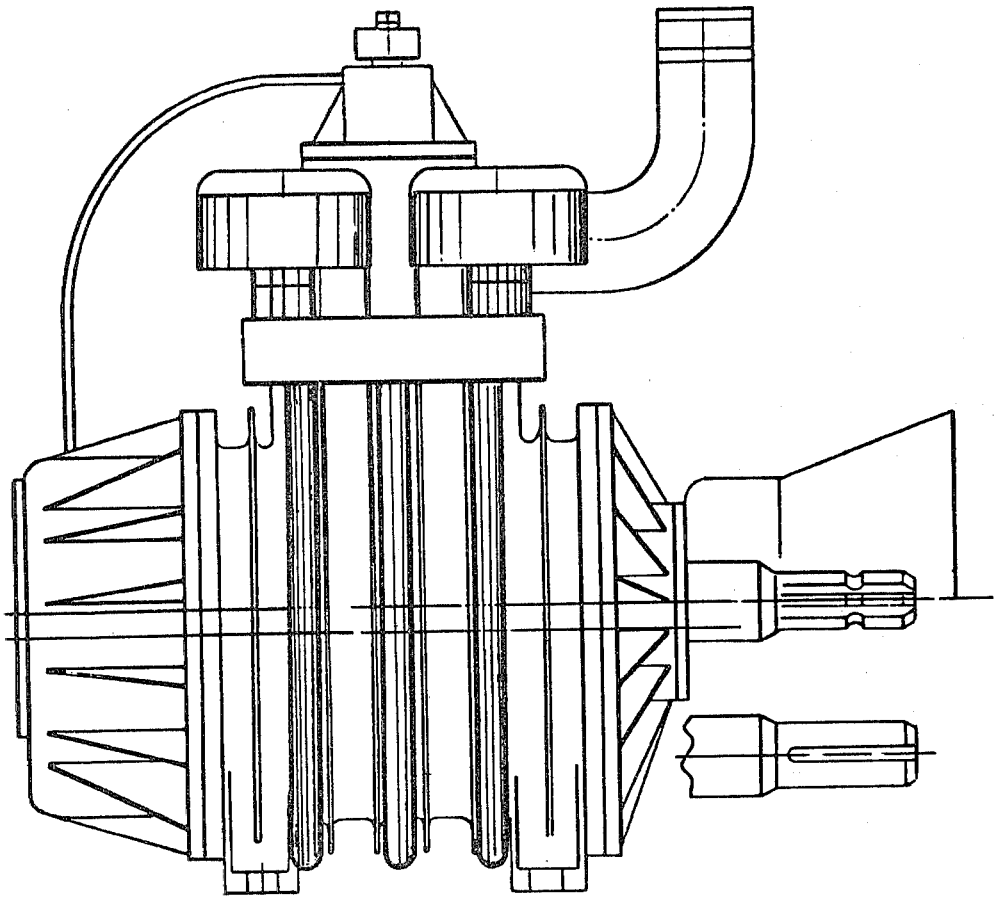
FIG. 2 is a front elevational view of the pump illustrated in FIG. 1.
Figure 3:
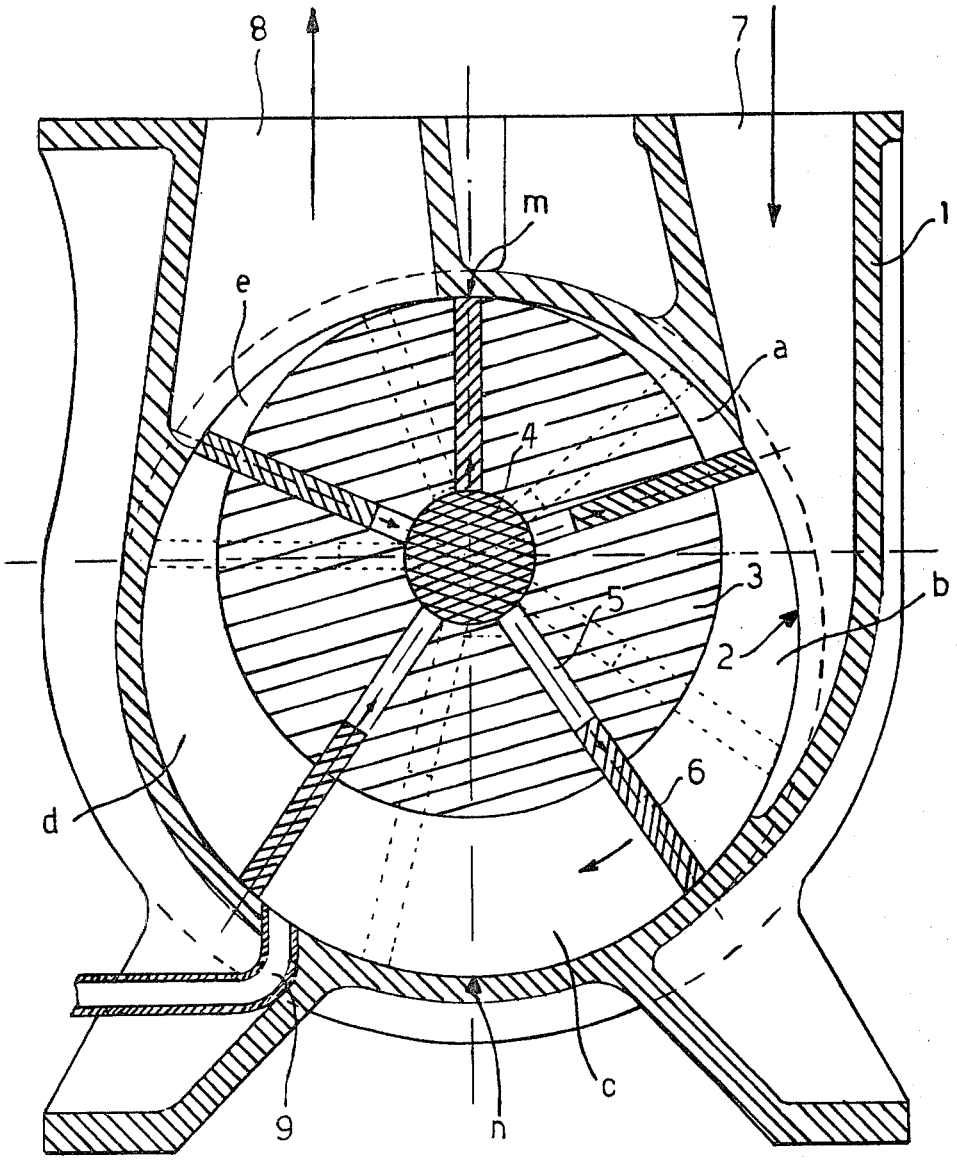
FIG. 3 is a side cross-sectional view of the pump illustrated in FIGS. 1 and 2 above.

Most of the major features of the invention may be best understood by referring to FIG. 3. The pump includes a stator body 1 provided with one or more inner cylindrical chambers 2. A rotor 3 is mounted on an axis 4 which is eccentrically located with respect to the center of the cylindrical chamber 2.

Rotor 3 includes a number of radial grooves 5 which receive free sliding lamellae or plates 6. The lamellae 6 are forced outwardly by centrifugal force against the inside of chamber 2 during the rotation of rotor 3. During rotation the lamellae 6 form a tight seal against the inner surface of the cylindrical chamber 2 of the stator 1. In this fashion a plurality of chambers is created. These chambers are indicated by the letters a, b, c, d, e as shown in FIG. 3.

The chambers a, b, c, d, e rotate in the direction indicated by the arrow in FIG. 3. During the first 180° of rotation of the rotor 3, the chambers progressively increase in volume. Conversely, during the second 180° of rotation the chambers progressively decrease in volume.

The contact point with the minimum rotor radius at the inside of the cylindrical chamber is indicated by the letter m. An intake suction port or hole 7 is located on the righthand side of contact point m. Similarly, an outlet port 8 is located on the left side of minimum radius contact point m. Suction port 7 and outlet port 8 are spaced so that there is no inner communication between them. In other words, the minimum wall distance between ports 7 and 8 is greater than the distance or arc between two adjacent lamellae as shown in FIG. 3.

The point n indicates the contact point with the maximum rotor radius and is located 180° away from the point of minimum rotor radius m. The first 180° of expansion takes place between points m and n in the direction of the arrow shown in FIG. 3. The second 180° of compression takes place between the points n and m in the direction of the arrow.

As shown in FIG. 3 one or more openings 9 are placed after point n in the direction of the arrow. Opening 9 communicates the inside of the pump by means of a suitable passageway to the outside ambient atmosphere. The location of opening or port 9 is such that the circle of arc existing inside the cylindrical chamber between opening port 9 and outlet port 8 is greater than the distance between the two adjoining lamellae in the same area so that no inner communication between ports 8 and 9 takes place.

The vacuum pump or decompressor of the present invention 10 works substantially in the following manner. The rotor 3 turns clockwise in the direction of the arrow and in doing so chamber b eventually passes in front of suction port 7. As it does so air is sucked in through port 7 because the volume of air in chamber b is increasing during the first 180° of rotation. A cooling down takes place during this decompression phase. Continued rotation of the rotor 3 causes the air or gas to occupy the location of chamber c and then chamber d. If passageway 9 were not in the location indicated then the gas at the location of chamber d would be compressed causing an increase in heat. However, when a passageway 9 is added to vent chambers c and d, then compression of the gas does not take place and accordingly, there is no reheating of the gas caused by the compression normally associated with such pumps. Further air compression inside the chamber is impossible because after the last lamellae has passed beyond port 9 the advancing lamellae in front of it begins to vent chamber d into discharge outlet 8 as chamber d assumes the location of chamber e.

The dotted line indicating lamellae in FIG. 3 show an intermediate phase during which chamber d does not undergo compression because of the presence of passageway 9. Therefore by carefully locating passageway 9 at the point where compression in chamber c might just begin and such that compression in chamber d doesn't take place because it will vent through exit port 8, it is possible to almost totally avoid any heat build up due to gas compression.

Furthermore, it should be observed that passageway 9 is located so as to balance the ejection of air or gas at a point which is opposite from the air suction phase of the pump at port 7. Therefore some cool external air may be received inside chamber c or d through port 9 thereby mixing with the internal gases. Washing by the external air tends to further help cool the inside of the pump chamber which is most subject to reheating by compression. As previously discussed before the location of port 9 is also significant in that:

A. It is situated so as to insure that chamber c does not significantly compress the air or gas therein; and, B. The circle of arc between port 9 and outlet port 8 is only slightly greater than the distance between two adjacent lamellae so that no significant compression takes place in chamber d before it is vented to outlet port 8.

While the invention has been described with reference to the preferred embodiment thereof, it will be appreciated by those of ordinary skill in the art that various different changes may be made to the structure and function of the device without departing from the spirit and scope of the invention.

What is claimed is:

1. An improved pump apparatus of the type having a stator body with an internal chamber for suction and compression, an input port, an output port, an eccentrically mounted rotor located within the chamber, the rotor including a plurality of radial lamellae mounted thereon, the lamellae adapted to make contract with the inside of the chamber through the influence of centrifugal force, and passageway means for venting the chamber at the location where the chamber formed by adjacent lamellae has its largest volume, wherein the improvement comprises:

(a) the passageway means is positioned such that a first arc between the passageway means and the output port is as long as an arc between points at which adjacent lamellae contact the inside chamber including the thickness of one lamella;

(b) the output port subtends an angle as large as the arc between the points at which adjacent lamellae contact the inside of the chamber;

(c) the input port is positioned such that a second arc from the output port to the input port is as long as the arc between the points at which adjacent lamellae contact the inside of the chamber;

(d) the input port subtends an angle smaller than the arc between the points at which adjacent lamellae contact the inside of the chamber; and, (e) the passageway is positioned such that a third arc between the passageway and the input port is as long as the arc between the points at which adjacent lamellae contact the inside of the chamber, including the thickness of one lamella, whereby, as each succeeding chamber volume is swept past the passageway means and on toward the output port, there occurs no significant compression of fluid enclosed within such chamber.

* * * * *